US011357330B2

(12) United States Patent
Bock

(10) Patent No.: US 11,357,330 B2
(45) Date of Patent: Jun. 14, 2022

(54) SUPPORT FOR SEATING FURNITURE AND ITEM OF SEATING FURNITURE

(71) Applicant: BOCK 1 GMBH CO. KG, Postbauer-Heng (DE)

(72) Inventor: Hermann Bock, Pyrbaum (DE)

(73) Assignee: BOCK 1 GmbH & Co. KG, Postbauer-Heng (DE)

( * ) Notice: Subject to any disclaimer, the term of this patent is extended or adjusted under 35 U.S.C. 154(b) by 0 days.

(21) Appl. No.: 17/148,773

(22) Filed: Jan. 14, 2021

(65) Prior Publication Data

US 2021/0219730 A1 Jul. 22, 2021

(30) Foreign Application Priority Data

Jan. 17, 2020 (DE) ..... 102020101034.6

(51) Int. Cl.

| | |
|---|---|
| ***A47C 3/026*** | (2006.01) |
| ***A47C 7/00*** | (2006.01) |
| ***A47C 7/56*** | (2006.01) |
| ***A47C 7/60*** | (2006.01) |

(52) U.S. Cl.

CPC ..... *A47C 7/566* (2013.01); *A47C 7/004* (2013.01); *A47C 7/563* (2013.01); *A47C 7/60* (2013.01)

(58) Field of Classification Search

CPC ..... A47C 7/004; A47C 7/563; A47C 7/566; A47C 7/60

See application file for complete search history.

(56) References Cited

U.S. PATENT DOCUMENTS

| | | | | |
|---|---|---|---|---|
| 6,352,308 | B1 * | 3/2002 | Chen | A47C 3/18 248/188.1 |
| 7,396,080 | B2 | 7/2008 | Suhr et al. | |
| 10,772,427 | B2 * | 9/2020 | Schuppler | A47C 3/0257 |
| 10,966,531 | B2 * | 4/2021 | France | A47C 7/006 |
| 2016/0235205 | A1 * | 8/2016 | Ballendat | A47C 1/022 |
| 2017/0013963 | A1 * | 1/2017 | Keilhauer | A47C 7/68 |
| 2017/0350552 | A1 * | 12/2017 | James | A47C 3/30 |
| 2019/0223603 | A1 * | 7/2019 | France | A47C 7/54 |
| 2020/0000231 | A1 * | 1/2020 | Schuppler | A47C 3/026 |

FOREIGN PATENT DOCUMENTS

| | | | |
|---|---|---|---|
| DE | 3319802 | U1 | 3/1994 |
| DE | 19620725 | A1 | 12/1997 |
| DE | 202004005366 | U1 | 6/2004 |

* cited by examiner

*Primary Examiner* — Rodney B White

(74) *Attorney, Agent, or Firm* — Laurence A. Greenberg; Werner H. Stemer; Ralph E. Locher

(57) ABSTRACT

A support for a piece of seating furniture provides an additional degree of freedom of movement. The support has a connecting unit fitted on a main body that connects to a supporting element of an underframe. The connecting unit has a mounting device for the supporting element, in particular a mount for the upper end of the supporting element. The connecting unit is fitted on the main body such that it is possible to alter the inclination of the main body relative to the supporting element. For that purpose the main body has a preferably convex contact base, which in the fitted state is contacted by a contact head of the connecting unit, with the abutment forming a non-planar contact rather than a contact over a surface area, in particular a punctiform contact.

20 Claims, 5 Drawing Sheets

SUPPORT FOR SEATING FURNITURE AND ITEM OF SEATING FURNITURE

CROSS-REFERENCE TO RELATED APPLICATION

This application claims the priority, under 35 U.S.C. § 119, of German patent application DE 10 2020 101 034.6, filed Jan. 17, 2020; the prior application is herewith incorporated by reference in its entirety.

BACKGROUND OF THE INVENTION

Field of the Invention

The invention relates to a support for a piece of seating furniture and to a piece of seating furniture having such a support.

Office chairs usually have a seat assembly fixed to an underframe. This underframe helps to support the chair on an underlying surface, for example the floor. If the underframe is a cruciform chair base or the like, a central supporting column usually serves as the single supporting element. In order to adjust the height of the seat, the supporting column can have a height-adjustable gas spring. The upper end of the supporting column which is usually tapers conically, is accommodated in a correspondingly formed conical mount on the underside of the seat assembly, wherein, for reasons of stability, this conical mount in most cases is connected in one piece with the corresponding component of the seat assembly.

The seat assembly of office chairs usually comprises a chair mechanism. Examples of mechanisms which are known for office chairs are, for example, synchronous mechanisms, asynchronous mechanisms and tilting mechanisms.

A synchronous mechanism is understood to cover assemblies in the seat substructure of an office chair which ensure coupled kinematics which give rise to a specific relative movement between the seat and backrest. The office-chair seat, which is usually provided with an upholstered seat surface, is mounted on the seat support. The backrest support, which commonly extends in the rearward direction from the actual synchronous mechanism, supports the backrest of the office chair on an upwardly running extension arm. The seat support and backrest support are usually coupled in an articulated manner such that a pivoting movement of the backrest in the rearward direction—as can be brought about, for example, by the user of the chair leaning against the backrest—induces a lowering movement of the rear edge of the seat in the downward direction. This prevents the so-called "shirt-pulling effect" and increases the seat comfort.

An asynchronous mechanism is understood to cover those assemblies in which the pivoting of the backrest does not bring about any movement of the seat support. In other words, when pivoting in the rearward direction takes place, it is only the backrest that moves. The seat comfort is reduced in comparison with synchronous mechanisms. In particular, the fact that the movement of the backrest and seat are not coordinated can result in the so-called "shirt-pulling effect" occurring in the case of asynchronous mechanisms. However, on account of their comparatively straightforward construction, such assemblies are considerably less expensive to produce than the above-described synchronous mechanisms.

Tilting mechanisms are comparatively straightforwardly constructed assemblies in the seat substructure of chairs in which the backrest support is connected more or less rigidly to the seat support, the seat or the frame of the chair. The resulting seat-support/backrest-support combination can be pivoted in the rearward direction about a pivot axis running transversely to the longitudinal direction of the seat when the user of the chair leans against the backrest. Such tilting mechanisms are often used in place of synchronous mechanisms in inexpensive visitor or conference chairs in order to realize a straightforward tilting function therein. Their comparatively straightforward construction means that tilting mechanisms are usually considerably less expensive to produce than the above-described mechanisms.

Common to all of these mechanisms is the fact that it is possible for one or more mechanism components to pivot in the longitudinal direction of the seat, i.e., in the forward or rearward direction.

Also described are mechanisms in which, usually in addition to a pivoting movement of one of the mechanism components in the forward or rearward direction, a lateral tilting movement of individual mechanism components to the right or left is possible, i.e., in a direction transverse to the longitudinal direction of the seat. This can offset some of the limitations relating to the movement of mechanism components in inexpensive chair mechanisms. However, such additional lateral movement capability can also be associated with disadvantages. In particular, it is often the case that the resulting overall movements of the mechanisms are not optimal from an ergonomic point of view.

Biomedical considerations, moreover, lead increasingly frequently to the lack of a further degree of freedom being considered to be disadvantageous in certain mechanism concepts, irrespective of whether, in addition to a pivoting movement of one or more mechanism components in the longitudinal direction of the seat, the specific mechanism already provides for tilting movements of one or more mechanism components in a direction transverse to the longitudinal direction of the seat.

In the case of the technical solutions proposed hitherto, both the provision of additional lateral movement capability of mechanism components and the attempts to provide a further degree of freedom of movement for one or more mechanism components are always associated with a considerably increased level of design outlay, as a result of which the costs of the piece of seating furniture increase.

BRIEF SUMMARY OF THE INVENTION

It is accordingly an object of the invention to provide a seating furniture support which overcomes the above-mentioned disadvantages of the heretofore-known devices and methods of this general type and which provides for a piece of seating furniture which has an additional degree of freedom of movement by way of a particularly low level of design outlay, and therefore in a cost-effective manner.

With the above and other objects in view there is provided, in accordance with the invention, a support for a piece of seating furniture, the support comprising:

a main body;

a connecting unit fitted to the main body, the connecting unit being configured for connecting the support to a supporting element of an underframe and having a mount for the supporting element;

the connecting unit being fitted on the main body to enable an inclination of the main body to be altered relative to the supporting element, wherein the main body has a contact base which, in a fitted state of the connecting unit, is in contact with a contact head of the connecting unit and abuts with the contact head at a given point rather than over an entire surface area, thereby forming a non-planar contact.

The contact base of the main body is preferably a convex contact base and the non-planar contact is a punctiform contact between the contact base and the contact head.

One concept of the invention is that the seat assembly is arranged in a movable manner on a fixed supporting element of an underframe, in particular such that it can be moved in all directions.

A further concept of the invention is to design a mounting device for the supporting element, in particular the conical mount, in the form of a separate component. In other words, the mounting device is not connected in one piece to the seat assembly, in particular it is not an integrated constituent part of the base support of a chair mechanism, nor is the mounting device fixed to the seat assembly. Instead, it is envisaged to design a support component of the seat assembly at least in two parts, wherein the one part of the support component, referred to hereinbelow as the connecting unit, comprises the mounting device for the supporting element, it being possible for said mounting device to be connected to the supporting element, whereas the other part of the support component, referred to hereinbelow as the main body, is arranged in a movable manner on the one part comprising the mounting device. The support component here is a structure which supports part of the piece of seating furniture, and it will also be referred to hereinbelow as support, for short. The support component is part of the seat assembly. In particular, the support component is a base support of a chair mechanism.

A further concept of the invention is to implement the interaction of the two parts of the support such that the main body has a contact base, against which a contact head of the connecting unit butts preferably always only at a single point, but in any case non-planar, i.e. not over a surface area. This is ensured by a suitable coordinated geometrical design of the contact surfaces of the contact base and contact head. In a preferred straightforward design, the contact base is shaped convexly, and the contact head is either planar or has an oppositely convex shape. The contact base of the main body and the contact head of the connecting unit come into contact with one another at any time at a single point. Movement of the main body relative to the fixed chair column causes the contact base of the main body to roll on the contact surface of the contact head. Sliding of the contact base on the contact head does not take place.

This contact at a single point provides an additional degree of freedom of movement of the main body and thus an additional degree of freedom in all directions in space for all of the components fitted on the main body. In other words, additional inclination of the seat assembly in relation to the supporting element in all directions (360 degrees) is possible. In the absence of a defined point of rotation or of an axis of rotation, the arrangement according to the invention does not provide any classic rotary articulation.

The main body of the support is advantageously inclined according to the invention relative to the supporting element only when the center of gravity of the user sitting on the piece of seating furniture is displaced. Such a center-of-gravity displacement takes place usually only as a result of an intended displacement of weight on the part of the user. During the action of the user sitting down on the piece of seating furniture, and while they are seated on the piece of seating furniture without any displacement of the center of gravity, in contrast, there is no inclination of the main body. According to a preferred embodiment of the invention, this is realized in that the interacting contact surfaces of the contact base and contact head are arranged obliquely in relation to the horizontal. This ensures that the virtual point of rotation in the non-inclined state of the seat assembly is located in the vicinity of, or at, the user's center of gravity.

According to a preferred embodiment of the invention, the main body has provided in it, preferably on its underside, which is oriented in the direction of the supporting element, an accommodating space for at least partially, but preferably fully or essentially fully accommodating the connecting unit. In this way, no additional installation space is required for the two-part design of the support and also the two-part formation of the support and the additional property realized by the invention to allow inclination of the main body in relation to the supporting element are not evident from the outside.

In one embodiment of the invention, the base of the accommodating space is designed in the form of a ball segment. This pan-like formation, with a circular contact surface, forms the contact base of the main body, with which the contact head makes direct contact. In another embodiment of the invention, the accommodating space incorporates an additional component which has a corresponding contact surface and forms the contact base.

A preferred embodiment of the invention provides a restoring arrangement, with the aid of which the inclined main body is restored independently into its non-inclined starting position. For this purpose, the restoring arrangement advantageously comprises a number of elastic restoring elements. If an accommodating space for accommodating the connecting unit is provided in or on the main body, the restoring elements act between, on the one hand, the contact base of the main body and, on the other hand, a support element, which is fixed to the main body of the base support, wherein the support element is, in particular, the closure cover which closes off the accommodating space in the downward direction. It is quite particularly advantageous that the user's weight does not have to be supported by the restoring elements.

A blocking arrangement with a number of blocking elements is provided by a preferred embodiment of the invention, it being possible for the inclination of the main body of the support in relation to the supporting element to be optionally prevented by said blocking arrangement. As the user wishes, the piece of seating furniture can then be used either with an additional degree of (inclination) freedom or without this degree of freedom.

The invention helps to provide a piece of seating furniture which has an additional degree of freedom of movement by way of a particularly low level of design outlay, and therefore in a cost-effective manner.

The invention makes it possible for a support or design elements connected to a support or components of a seat assembly, of a chair mechanism, of a seat or of a piece of seating furniture in general to be inclined relative to a supporting element in all directions. This inclination movement is possible both in addition to, and irrespective of whether, the support can also perform a pivoting and/or tilting movement. The inclination movement provided by the invention can also be the sole way in which the support moves relative to the supporting element.

The invention differs from all the hitherto known solutions for realizing an additional degree of freedom both by the selection of the location where the movements are decoupled and by the way in which this decoupling is realized in design terms. Whereas the prior art is always based on the connection between the supporting element and seat assembly always having to have the highest possible levels of strength and stability, especially as the conical mount is the location in the piece of seating furniture which, from a design point of view, is the most delicate, and which is subjected to the greatest forces during use, the invention proposes to allow a relative movement between the support and supporting element at this location.

It is not just possible for the support according to the invention, comprising a correspondingly designed main body and the appropriate connecting unit, to be designed in the form of part of an (office) chair mechanism, in particular in the form of a base support of a synchronous, asynchronous or tilting mechanism. However, the invention is not limited to being used in mechanisms; rather, it can also be used in all other types of pieces of seating furniture, for example by a support with these properties being used as part of a seat assembly of any desired design or by a seat of a piece of seating furniture being provided in some other way with such a support. In particular, it is also possible for an otherwise fully rigid seat assembly, for example a single-piece seat shell or a single-piece seat/backrest combination, to have such a support.

The invention can preferably be used in pieces of seating furniture of which the underframe has a single, preferably centrally arranged, supporting element. However, other uses are also possible, in particular those in which a piece of seating furniture comprises two or more supports according to the invention. This can be the case, for example, when a seat assembly comprises a plurality of partial seat elements which are arranged one beside the other and are each placed individually on supporting elements of an underframe. In such a case, each of the supporting elements can be assigned a support according to the invention, and therefore the partial seat elements can execute the inclination movement relative to their supporting elements independently of one another.

Other features which are considered as characteristic for the invention are set forth in the appended claims.

Although the invention is illustrated and described herein as embodied in support for a piece of seating furniture, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

All the figures show the invention in a manner which is not true to scale, merely schematically and only with the essential constituent parts thereof. Identical reference signs here correspond to elements which have an identical or comparable function.

"Forward" or "front" here means that a component is arranged at the front, as seen in the longitudinal direction of the seat, or refers to a component which extends in the direction of the front seat edge or is oriented in this direction, whereas "rearward" or "rear" means that a component is arranged at the rear, as seen in the longitudinal direction of the seat, or refers to a component which extends in the direction of the backrest or of the backrest support or of the rear seat edge or is oriented in this direction. The details "upward/upwardly" and "downward/downwardly/bottom" refer to the intended use state of the office chair or of the office-chair mechanism.

Figure 1:
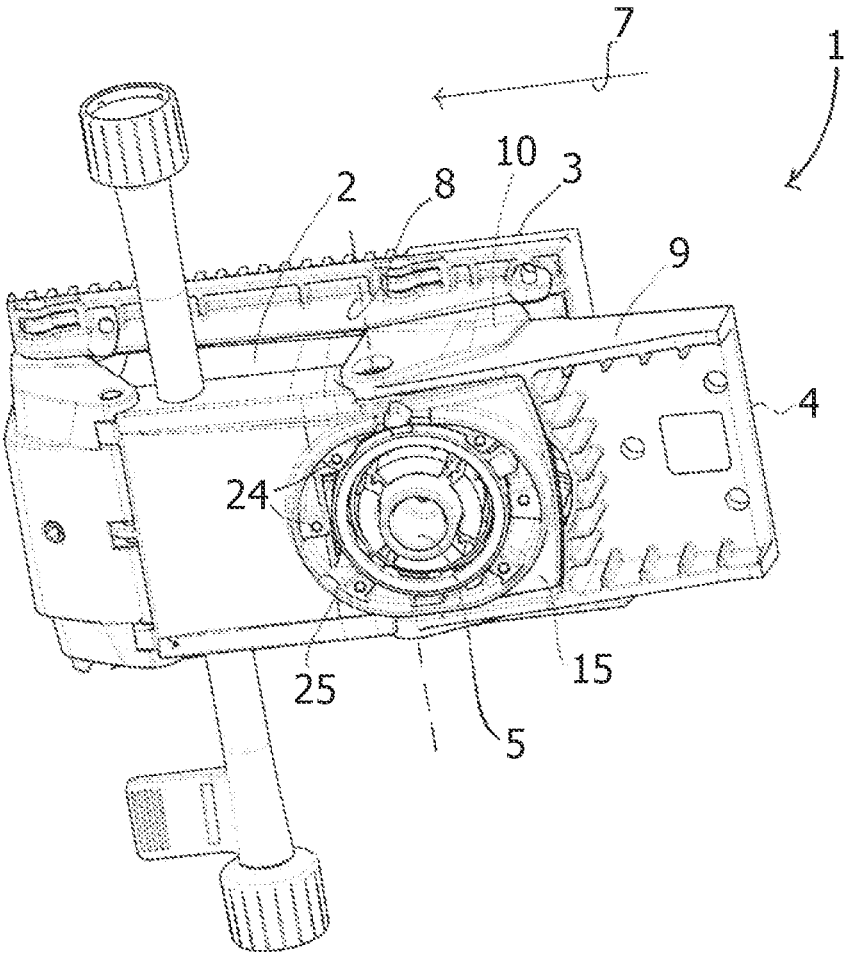
FIG. 1 is a perspective view, from the bottom, of an office-chair mechanism according to the invention.
Figure 2:
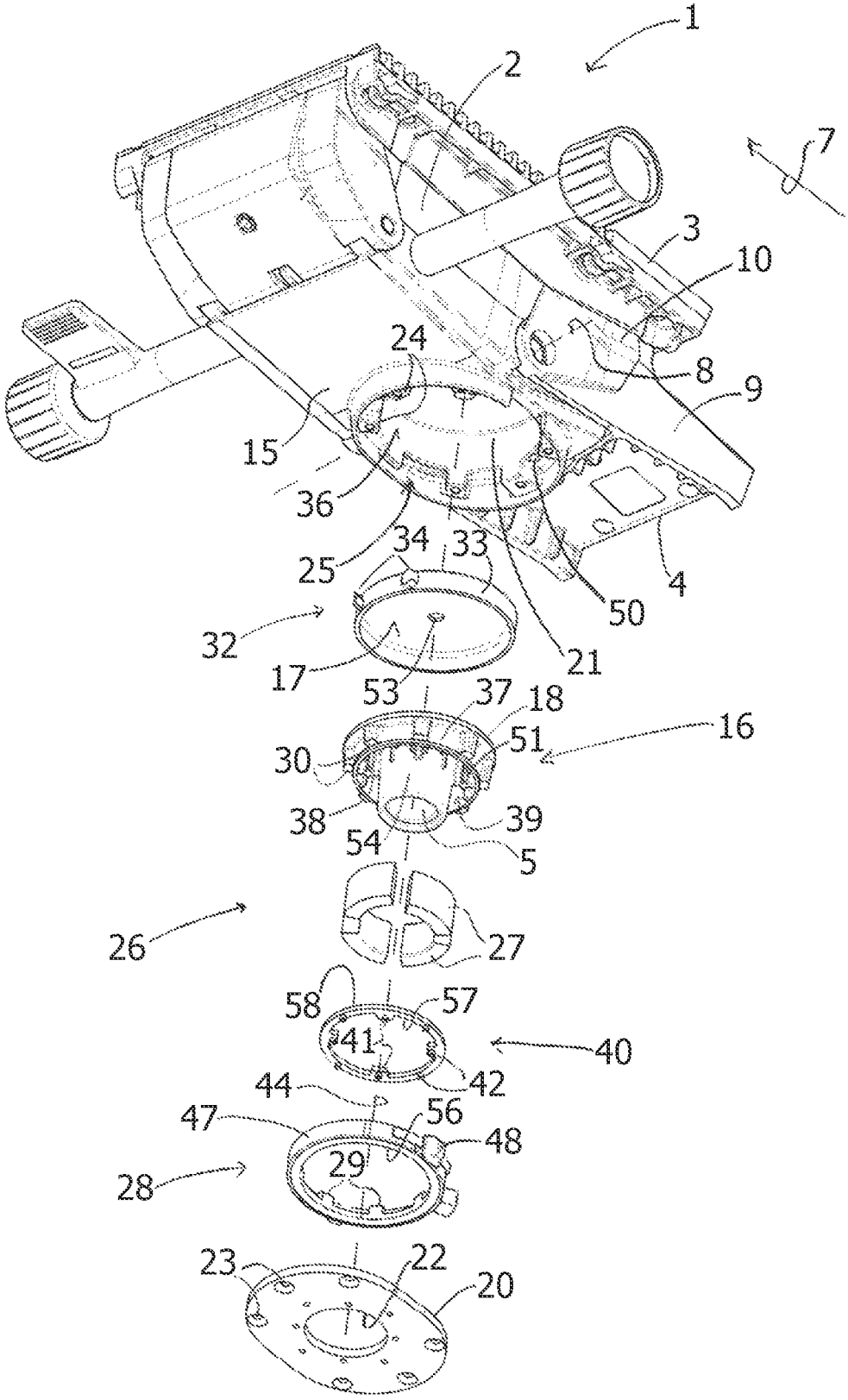
FIG. 2 shows a first exploded, perspective view of the chair mechanism with a connecting unit removed from the accommodating space.
Figure 3:
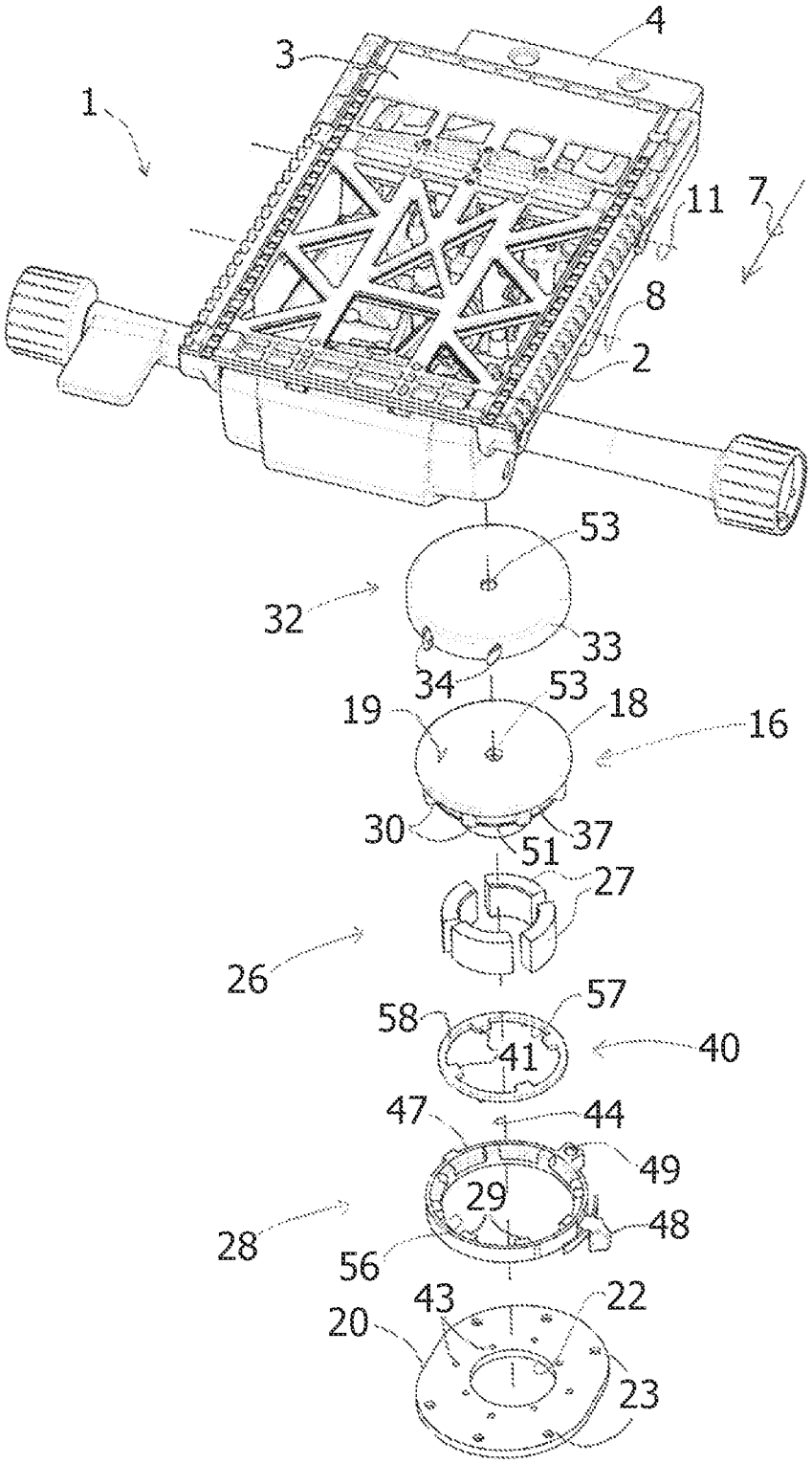
FIG. 3 shows a second exploded, perspective view of the chair mechanism with the connecting unit removed from the accommodating space (exploded illustration)
Figure 5:
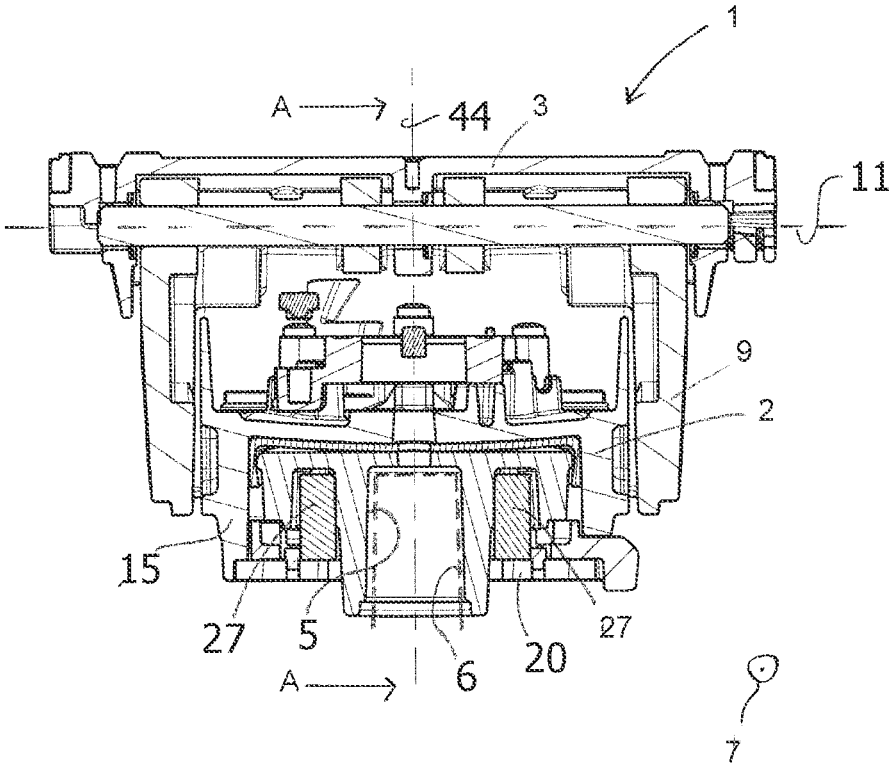
FIG. 5 shows a cross section through the chair mechanism taken along line B-B in FIG. 4, in the non-inclined state in relation to the chair column.

Referring now to the figures of the drawing in detail and first, in particular, to FIG. 1 thereof, there is shown a chair mechanism 1—here a synchronous mechanism—having a base support 2, a seat support 3 and a backrest support 4. The base support 2 is positioned on the upper end of a chair column 6 by means of a conical mount 5, as is indicated in FIG. 5 by dashed lines. The chair column 6 here forms the supporting element of an underframe (cruciform base, not depicted).

The seat support 3 is provided for accommodating a, preferably upholstered, seat surface or to have such a seat surface mounted on it. Mounting takes place in a conventional manner with the aid of fastening elements (not illustrated specifically). A backrest (not illustrated specifically) is fitted on the backrest support 4, it being possible for the backrest of modern office chairs to be adjusted in height. The backrest can also be connected in one piece to the backrest support 4.

The entire synchronous mechanism 1 is of mirror-symmetrical construction in relation to its center longitudinal plane, as far as the actual kinematics are concerned. To this extent, the following description of the mechanism is always based on design elements which are present in pairs on either side.

Figure 6:
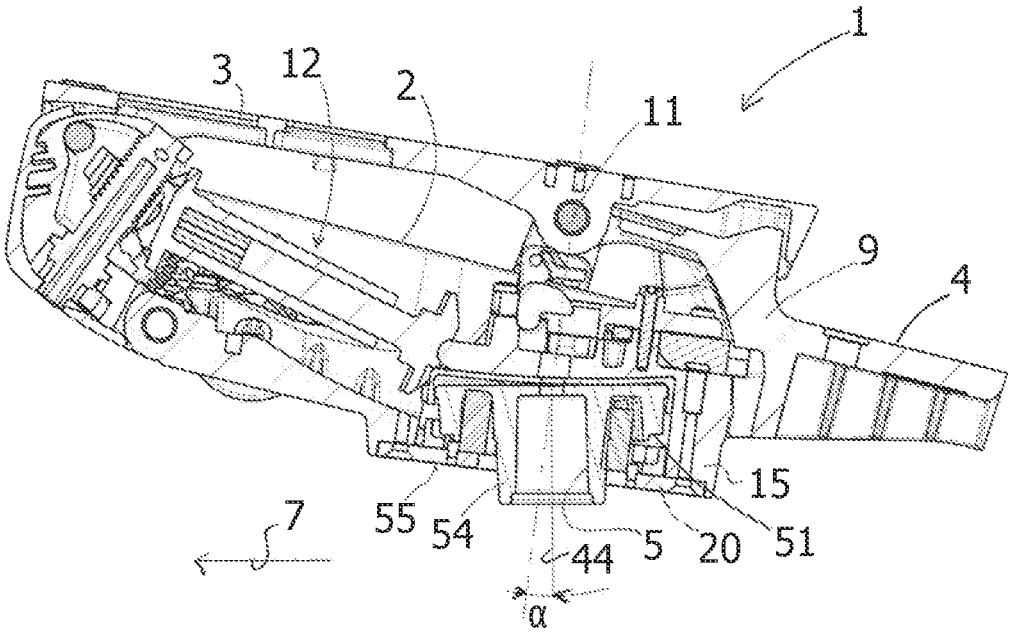
FIG. 6 shows a longitudinal section through the chair mechanism taken along line A-A in FIG. 5, in the inclined state in relation to the chair column.
Figure 7:
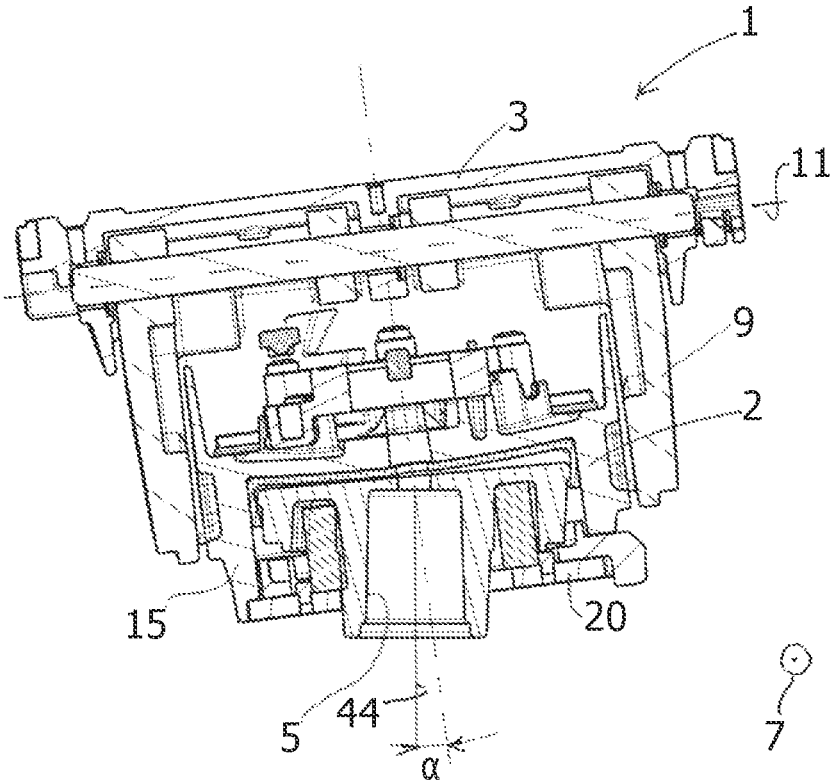
FIG. 7 shows a cross section through the chair mechanism taken along line B-B in FIG. 4, in the inclined state in relation to the chair column.

All the figures show the main position of the synchronous mechanism 1, in which the seat support 3 assumes an essentially horizontal position and the backrest support 4 has not been pivoted in the rearward direction in relation to the base support 2. The oblique position which is illustrated in FIGS. 6 and 7 represents the inclination of the base support 2 and therefore also of all the design elements connected to the base support 2, including the seat support 3 and the backrest support 4, relative to the fixed, i.e. non-inclined, chair column 6.

In the rear region of the mechanism 1, as seen in the longitudinal direction 7 of the seat, the backrest support 4, which can be pivoted about a first transverse axis 8, which defines the fixed main pivot axis of the mechanism 1, is connected in an articulated manner directly, on the one hand, to the base support 2, level with the conical mount 5, and, on the other hand, to the rear region of the seat support 3.

The backrest support 4 here has its sidepieces 9, which extend in the direction of the front seat region, articulated directly on the base support 2. Upwardly extending drivers 10 of the sidepieces 9 connect the backrest support 4 in an articulated manner directly to the seat support 3, a second transverse axis 11 being formed in the process. In order to achieve the synchronous movement desired for this specific mechanism, and for weight-adjustment reasons, the second transverse axis 11 is located behind the first transverse axis 8, as seen in the longitudinal direction 7 of the seat.

The seat support 3 is likewise connected to the base support 2 in an articulated manner in the front seat region, and therefore, when the backrest support 4 pivots in the rearward direction, the seat support 3 is moved in the rearward direction relative to the base support 2, this resulting in the desired synchronous movement of the seat support 3 and backrest support 4. A spring arrangement 12 which is fitted in the interior of the mechanism 1 defines the pivoting resistance of the backrest support 4 and serves to return the backrest support 4 from the pivoted position to its starting position as soon as the user of the chair is no longer leaning against the backrest. The position of the front ends of the spring elements which are used in the spring arrangement 12 can be adjusted by an adjustment mechanism, as a result of which it is possible to alter the pivoting resistance of the synchronous mechanism.

The base support 2 has a main body 15. This is essentially the housing of the base support 2. A connecting unit 16 is fitted on the main body 15 in order to establish a connection between the base support 2 and the chair column 6. The connecting unit 16 has a mounting device for the chair column 6, namely the conical mount 5 for the upper, conical end of the chair column 6. The connecting unit 16 here is fitted on the main body 15 such that it is possible to alter the inclination of the main body 15 relative to the chair column 6 with the aid of, or by, the connecting unit 16. For this purpose, the main body 15 has a convex contact base 17, with which a contact head 18 of the connecting unit 16 comes into contact in the fitted state, with abutment in particular at a certain point rather than over a surface area. As a result, the base support 2 rests on the chair column 6 only at a single point, since the formation of the contact surface 19 of the contact head 18 differs from the formation of the contact base 17 of the main body 15, in particular because the contact surface 19 of the contact head 18, which is in the form of the counterpart to the contact base 17, is planar and not, in adaptation to the shape of the contact base 17, concave. As an alternative to a planar design of the contact surface 19 of the contact head 18, it is also possible for the contact surface to be convex, i.e. to be curved in the direction of the contact base 17, or else the contact surface 19 of the contact head 18 has some other surface-area configuration which ensures that the contact base 17 of the main body 15 rests on the contact head 18 only at a single point.

The connecting unit 16 is fitted on the main body 15, in the case of the illustrated exemplary embodiment, by the connecting unit 16 being arranged between the contact base 17 and a closure cover 20 of the main body 15. The closure cover 20 can be fixed to the main body 15 using suitable fastening means, such as screws, and closes off an accommodating space 21 of the main body 15. The closure cover 20 here closes the access opening 25 of the accommodating space 21. This accommodating space 21 is located in the interior of the main body 15 and essentially fully accommodates the connecting unit 16. Only part of the conical mount 5 projects downward out of the closure cover 20, in the mounted state, for which purpose the closure cover 20 has an exit opening 22. For the purpose of mounting the closure cover 20, the latter has mounting openings 23 for screws; corresponding threaded openings 24 are provided on the main body 15.

The base support 2 comprises a restoring arrangement 26 with a number of resilient restoring elements 27, wherein these restoring elements 27 are designed, and arranged, such that, upon inclination of the main body 15 relative to the chair column 6, at least one of the restoring elements 27 is activated. The restoring elements 27, which serve as energy stores for a restoring force, are designed here in the form of elastic spring elements. These are preferably elements made of a suitable solid material, in particular an elastomer. Therefore, inclination of the base support 2 relative to the chair column 6 always takes place counter to the spring force of the restoring arrangement 26. In other words, the restoring arrangement 26 serves to restore the main body 15 from an inclined position into its starting position. The design selected for the restoring arrangement 26 means that it is not necessary for the spring elements 27 to support the user's weight. As a result, they can be of particularly small dimensions and/or be produced from materials which do not have to meet requirements of any note in relation to material properties. Since the restoring arrangement 27 moves along with the main body 15, i.e., upon inclination of the main body 15 in relation to the stationary connecting unit 16, which is fixed to the chair column 6, it likewise inclines, the restoring arrangement 26 can be assigned to the main body 15 as far as movement is concerned.

In the example illustrated, the connecting unit 16 is fitted on the main body 15 of the base support 2 such that the spring elements 27 of the restoring arrangement 26 are supported, on the one hand, on the contact head 18 of the connecting unit 16 and, on the other hand, on a support element which is fixed to the main body 15 of the base support 2, the support element being the closure cover 20 of the accommodating space 21.

Therefore, the connecting unit 16, in the fitted state, has been essentially fully inserted in the accommodating space 21 of the main body 15 and is incorporated loosely in this accommodating space 21, wherein the contact base 17 of the main body 15 rests on the contact head 18 at a single point. In other words, the main body 15 can incline in all directions relative to the fixed-position chair column 6. The connecting unit 16 is fitted firmly at the upper end of the chair column 6 by the cone of the chair column 6 being placed in the conical mount 5 of the connecting unit 16. The inclination of the main body 15 relative to the chair column 6 takes place here in dependence on the force which is exerted by the user of the chair and acts on the main body 15. The inclination takes place through a specific maximum angle of inclination a, which is defined inter alia by the curvature of the contact base 17 of the main body 15 and by the design-related distances between the components which move in relation to one another and/or by the existence of defined stops.

In the example illustrated, the contact base 17 is not designed in the form of an integrated part of the main body 15. Instead, the contact base 17 is formed by an intermediate piece 32 which interacts with the main body 15, that is to say butts against the main body 15.

In the example illustrated, both the main body 15, and therefore also the base of the accommodating space 21, and the contact head 18 of the connecting unit 16, but in any case the contact surface 19 of the contact head 18, are manufactured from a metallic material, in this case from an aluminum material, and so an intermediate piece 32 made of a plastic material is inserted between the connecting unit 16, on the one hand, and the base support 2, on the other hand. This prevents the two metallic components 15, 18 from coming into direct contact with one another. The surface of the intermediate piece 32 is designed to have particular sliding capability. In particular, use is made of a plastic material with a low coefficient of friction. The intermediate piece 32 is designed such that it has its upper side incorporated in a precisely fitting manner in the accommodating space 21. The underside of the intermediate piece 32, said underside serving as the contact base 17, has the convex shape which is required for the interaction according to the invention with the contact head 18.

The circular intermediate piece 32 has a wall 33, which encompasses the contact base 17 and has two outwardly projecting centering noses 34, by way of which the intermediate piece 32 is incorporated in the accommodating space 21. Whereas the centering noses 32 interact with corresponding centering mounts (not depicted) on the inner wall 36 of the accommodating space 21 in order to ensure that the intermediate piece 32 is arranged in a rotationally secured manner in the accommodating space 21, the wall 33 of the intermediate piece 32 prevents the contact head 18 of the connecting unit 16, said contact head in the installed state always being located within this wall 33, from coming into contact with the inner wall 36 of the accommodating space 21. In the mounted state, the intermediate piece 32 is fixed to the main body 15, and can therefore be assigned to the main body 15 as far as movement is concerned.

The connecting unit 16, which is incorporated loosely in the accommodating space 21, comprises the contact head 18 with a rotationally symmetrical, circular contact surface 19, which in the mounted state is oriented upward in the direction of the contact base 17. The downwardly open conical mount 5 is provided, in the form of a mounting device for the cone of the chair column 6, on that side of the contact head 18 which is located opposite the contact surface 19.

The cylindrical outer wall 37 of the contact head 18, said outer wall likewise extending downward from the circumference of the contact head 18, and encompassing the contact surface 19, is provided with radially running connecting struts 38 to the conical mount 5 such that circle-segment-form accommodating pockets 39 for a corresponding number of restoring elements 27 form between the inner side of said outer wall 37 and the outer side of the accommodating cone 5. The connecting struts 38 serve, at the same time, as stiffening ribs for increasing the mechanical stability of the connecting unit 16.

In the example illustrated, a total of four accommodating pockets 39, for accommodating four corresponding restoring elements 27, are formed. In the example shown, use is made of four identical spring elements 27 in the form of ring segments. In the case of an appropriate design modification, it is also possible to use a different number of restoring elements 27. Thus, for example, it is also conceivable to use a single annular (hollow-cylindrical) restoring element.

The inclination resistance of the main body 15 can be defined by a suitable material being selected for the spring elements 27. In particular when use is made of a plurality of elastic restoring elements 27 within a contact head 18, the inclination property of the main body 15 in relation to the chair column 6 can also be set in a direction-dependent manner, for example by using materials with different levels of elasticity. It is thus possible to set, for example, different inclination resistances and restoring forces, on the one hand, for inclination of the main body 15 in the longitudinal direction 7 of the seat and, on the other hand, for inclination in a direction transverse to the longitudinal direction 7 of the seat.

The spring elements 27 have their one end engaging in the accommodating pockets 39 of the contact head 18 and their other, opposite ends supported on the closure cover 20, which forms an abutment. The spring elements 27 here are encompassed, and positioned in relation to one another, by a retaining ring 40, which forms a separate component, wherein four spacer elements 41, which extend radially inward from the body of the retaining ring 40 and are in alignment with the connecting struts 38, prevent the spring elements 27 from coming into contact with one another in the region of their foot ends. This retaining ring 40 is provided, on its underside, with mounting pins 42, which in the mounted state engage in corresponding mounts 43 in the closure cover 20 and thus prevent rotation of the restoring arrangement 26 in the accommodating space 21 of the base support 2, and thus at the same time rotation of the connecting unit 16 in the accommodating space 21, about the chair-column axis 44.

In the non-inclined state of the main body 15 relative to the chair column 6, the connecting unit 16 rests on the spring elements 27 by way of the contact head 18, more precisely by way of its inner side, which is located opposite the contact surface 19, while the conical mount 5 extends downward out of the main body 15, through the closure cover 20. If the main body 15 of the base support 2 is inclined relative to the chair column 6 as a result of the user of the chair moving, the contact base 17 of the intermediate piece 32 of the main body 15 rolls on the contact surface 19 of the contact head 18. This results in corresponding activation of one or more spring elements 27, which become compressed, see FIGS. 6 and 7. The direction of inclination of the main body 15 is immaterial in relation to such activation of the spring elements 27 taking place. Thus, for example FIG. 6 shows a rearwardly inclined main body 15 and FIG. 7 shows a main body 15 inclined to the right. It is also possible, however, for the inclination to take place to the rear and to the right simultaneously and the like. The activation of the spring elements 27, and in the simplest case also the intensity of this activation, does not depend on the direction of inclination (0° to) 360°, and therefore the inclination resistance is the same in all directions, as is the restoring force.

When the main body 15 is no longer subjected to loading by the user of the chair, the restoring forces of the activated spring elements 27 cause the main body 15 to right itself again from the inclined position into the non-inclined, starting position.

Depending on how the user sitting on the chair moves, there is overlap, on the one hand, between the inclination movement of the main body 15, which is caused by displacement of the user's center of gravity on the seat, and, on the other hand, the pivoting movement of the synchronous mechanism 1, which is caused by activation of the backrest. If the pivoting movement is blocked for a time by a backrest-support-blocking or seat-support-blocking device which may be present on the mechanism 1, then, during this time, it is only the inclination movement according to the invention which takes place, and resting of the user against the backrest does not result in any synchronous movement of the backrest support 4 and seat support 3. If, in contrast, the inclination movement is blocked, displacement of the user's center of gravity does not result in any inclination of the main body 15 of the base support 2 of the mechanism 1.

In order to block the inclination movement, in the example depicted, the base support 2 is provided with a blocking arrangement 28, which has a number of first blocking elements 29, wherein the first blocking elements 29 can be transferred, by movement of at least one part of the blocking arrangement 28 relative to the base support 2, from a functional position, in which inclination of the main body 15 relative to the chair column 6 is possible, into a blocking position, in which the inclination of the main body 15 relative to the chair column 6 is not possible, and back, wherein, in the blocking position, the first blocking elements 29 of the blocking arrangement 28 interact with second blocking elements 30, which are arranged on the connecting unit 16, to give a form fit which prevents relative movement between the main body 15 and chair column 6. Since the blocking arrangement 28 also moves along with the base support 2, i.e. upon inclination of the main body 15 in relation to the stationary connecting unit 16, which is fixed to the chair column 6, it likewise inclines, the blocking arrangement 28 can also be assigned to the main body 15 as far as movement is concerned.

In the illustrated exemplary embodiment, the blocking arrangement 28 comprises a blocking ring 47, which can be operated manually by the user of the chair by actuation of a handle 48, which is fitted on the outer side of the ring 47 and in the mounted state passes through a corresponding opening in the wall of the accommodating space 21. The blocking ring 47 here can be moved from the functional position into the blocking position, and back, by rotation about the chair-column axis 44. In the blocking position, stops 29, which are fitted on the inner side of the blocking ring 47, are arranged in relation to blocking noses 30, which are fitted on the outer side of the outer wall 37 of the contact heat 18 and serve as counterparts to the stops 29, such that inclination of the blocking ring 27, and thus of the main body 15, relative to the connecting unit 16, which is fixed on the chair column 16, is no longer possible. The internal diameter of the blocking ring 47 is dimensioned such that it engages around the retaining ring 40 for the spring elements 27 and, in the blocked state, the stops 29 of the blocking ring 47 are located directly opposite the blocking noses 30 of the contact head 18. The external diameter of the retaining ring 40 here is coordinated with the internal diameter of the blocking ring 47 such that, in the mounted state, the blocking ring 47 retains the retaining ring 40.

The blocking ring 47 can be moved into two defined latching positions, wherein the one latching position corresponds to the functional position and the other latching position corresponds to the blocking position. The blocking ring 47 is secured in the latching positions by a suitable latching device, for example by means of a spring-loaded latching ball 49, which is fitted on the outside of the blocking ring 47 and can be latched into a corresponding latching recess 50 in the main body 15.

The primarily important parts of the blocking arrangement 28, that is to say all the parts with the exception of the blocking noses 30, can be assigned to the main body 15 as far as movement is concerned, since, upon inclination of the main body 15, they move along therewith. In contrast, the second blocking elements 30, which are fitted on the connecting unit 16 and can likewise be functionally included with the blocking arrangement 28, can be assigned to the stationary combination of connecting unit 16 and chair column 6 as far as movement is concerned.

The inclination of the main body 15 of the base support 2 in all directions, said inclination being made possible with the aid of the connecting unit 16, is preferably 5°±1° relative to the vertical (chair-column axis 44). The extent of inclination can be delimited by suitable stops. In the example illustrated, the delimitation is provided by the end surface 51 of the outer wall 37 of the contact head 18. This annular stop end surface 51 is formed by the downwardly oriented free end of the outer wall 37. In its fully inclined state, the main body 15 strikes against this end surface 51 by way of the upper side 58 of the retaining ring 40, see FIGS. 6 and 7. Using the encircling retaining ring 40 as an inclination stop makes it possible to delimit the angle of inclination for inclinations in all directions (360°).

The conical mount 5 of the connecting unit 16 is oriented vertically, in a manner corresponding to the typically vertical arrangement of the chair column 6. However, in the non-inclined, starting position, the position of the contact surface 19 of the contact head 18, and the position of the corresponding contact base 17 of the intermediate piece 32, on the main body 15 need not necessarily be horizontal. In the example illustrated, the base of the accommodating space 21 of the base support 2 is arranged obliquely in relation to the horizontal, that is to say in a state in which it slopes up from front to rear, as seen in the longitudinal direction 7 of the seat. Correspondingly, the intermediate piece 32 is also provided with an obliquely running contact base 17 and the contact surface 19 of the contact head 18, rather than running horizontally, likewise runs obliquely in relation to the chair-column axis. Accordingly, the height of the outer wall 37 of the contact head 18 alters along the longitudinal direction 7 of the seat.

Figure 4:
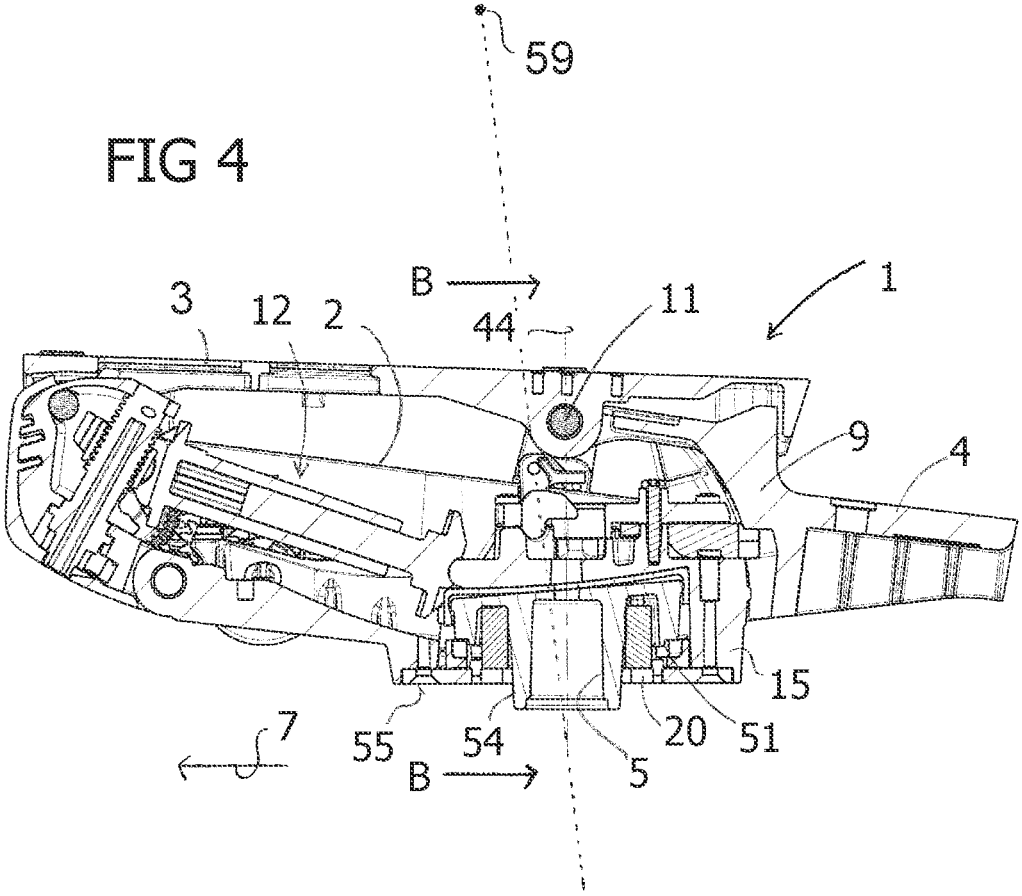
FIG. 4 shows a longitudinal section through the chair mechanism taken along line A-A in FIG. 5, in the non-inclined state in relation to the chair column.

Such an oblique arrangement of the rolling surfaces 17, 19 results in the virtual point of rotation 59 of the mechanism 1 being located in the vicinity of, or ideally precisely at, the center of gravity of the user's body when the main body 15 has not been inclined, see FIG. 4. This prevents the main body 15 from performing an inclination movement in relation to the chair column 6 merely as a result of somebody sitting on the chair. For inclination of the main body 15, instead intended displacement of the user's center of gravity is necessary. However, a non-oblique, i.e., fully horizontal, arrangement of the contact surface 19 and/or of the contact base 17 is likewise possible for use of the invention in a different chair mechanism, seat assembly or the like.

The chair column 6 which is used in the example has a gas pressure spring (not illustrated) for the height adjustment of the seat assembly. For operation of this gas pressure spring, both the base of the accommodating space 21 and the intermediate piece 32 and also the contact surface 19 of the contact head 18 are each provided centrally with through-passage openings 53 for an actuating pin or the like (not depicted), said through-passage openings being in alignment with one another in the definitively mounted state.

In the definitively mounted state, it is therefore the case that the intermediate piece 32, the restoring arrangement 26, with its spring elements 27 and the associated retaining ring 40, and also the blocking arrangement 28 are incorporated in a fixed position in the accommodating space 21. At the same time, the connecting unit 16 is incorporated loosely in the accommodating space 21. The accommodating space 21 is closed off by the closure cover 20. In the mounted state, the shank 54 of the conical mount 5 projects partially out of the underside 55 of the base support 2. For this purpose, the closure cover 20 has a central exit opening 22. In order to allow inclination of the main body 15 in relation to the chair column 6, the diameter of the exit opening 22, which also performs the inclination movement, is greater than the diameter of the stationary conical mount 5. It is also the case that the blocking ring 47 and also the retaining ring 40 for the spring elements 27 are provided with through-openings 56, 57 of sufficient size for the conical mount 5, which is fitted on the contact head 18.

Once more by way of a brief summary, the invention relates to a support for a piece of seating furniture and to a piece of seating furniture having such a support. In order to provide a piece of seating furniture which has an additional degree of freedom of movement by way of a particularly low level of design outlay, and therefore in a cost-effective manner, the invention envisages the use of a support, having a connecting unit, which is fitted on a main body of the support and is intended for connecting the support to a supporting element of an underframe, in particular to a supporting column or the like, wherein the connecting unit has a mounting device for the supporting element, in particular a mount for the upper end of the supporting element, wherein the connecting unit is fitted on the main body such that it is possible to alter the inclination of the main body relative to the supporting element, for which purpose the main body has a preferably convex contact base, with which in the fitted state is contacted by a contact head of the connecting unit comes into contact in the fitted state, with abutment in particular at a certain point rather than over a surface area, thereby forming a non-planar contact, in particular a point contact.

All the features which are illustrated in the description, the claims which follow, and the drawing can be essential to the invention both individually and in any desired combination with one another.

The following is a summary list of reference numerals and the corresponding structure used in the above description of the invention:

1 Chair mechanism
2 Base support
3 Seat support
4 Backrest support
5 Conical mount, mounting device
6 Chair column, supporting element
7 Longitudinal direction of the seat
8 First transverse axis, main axis of rotation
9 Sidepiece
10 Driver
11 Second transverse axis
12 Spring arrangement
13 (free)
14 (free)
15 Main body
16 Connecting unit
17 Contact base
18 Contact head
19 Contact surface
20 Closure cover
21 Accommodating space
22 Exit opening
23 Mounting opening
24 Threaded opening
25 Access opening
26 Restoring arrangement
27 Restoring element, spring element
28 Blocking arrangement
29 First blocking element, stop
30 Second blocking element, blocking nose
31 (free)
32 Intermediate piece
33 Wall
34 Centering nose
35 (free)
36 Inner wall
37 Outer wall
38 Connecting strut
39 Accommodating pocket
40 Retaining ring
41 Spacer element
42 Mounting pin
43 Mount
44 Chair-column axis
45 (free)
46 (free)
47 Blocking ring
48 Handle
49 Latching ball
50 Latching recess
51 Stop end surface
52 (free)
53 Through-passage opening
54 Shank
55 Underside of the base support
56 Through-opening
57 Through-opening
58 Upper side of the retaining ring
59 Virtual point of rotation, instantaneous center of rotation
$\alpha$ Angle of inclination

The invention claimed is:

1. A support for seating furniture, comprising:

a main body;

a connecting unit fitted to said main body, said connecting unit being configured for connecting the support to a supporting element of an underframe and having a mount for the supporting element;

said connecting unit being fitted on said main body to enable an inclination of said main body to be altered relative to the supporting element, wherein said main body has a contact base which, in a fitted state of said connecting unit, is in contact with a contact head of said connecting unit and abuts with said contact head at a given point forming a non-planar contact; and said connecting unit being arranged between said contact base and a closure cover of said main body, and said closure cover being fixed to said main body and closing off an accommodating space of said main body that accommodates said connecting unit at least partially.

2. The support according to claim 1, wherein said contact base of said main body is a convex contact base and said non-planar contact is a punctiform contact between said contact base and said contact head.

3. The support according to claim 1, wherein said main body is configured for connection to a supporting column and said connecting unit has a mount for an upper end of said supporting column.

4. The support according to claim 1, further comprising a restoring arrangement with a plurality of restoring elements, wherein, upon an inclination of said main body relative to the supporting element, at least one of said restoring elements is activated by said connecting unit, in particular by the contact head.

5. The support according to claim 4, wherein, upon the inclination of said main body relative to the supporting element, the at least one of said restoring elements is activated by said contact head.

6. The support according to claim 4, wherein said connecting unit is fitted on said main body such that said restoring elements of said restoring arrangement are supported on said contact head of said connecting unit and on a support element that is fixed to said main body.

7. The support according to claim 6, wherein said support element is a closure cover fixed to said main body and closing off an accommodating space of said main body that accommodates said connecting unit at least partially.

8. The support according to claim 1, further comprising a blocking arrangement with a plurality of first blocking elements, wherein said first blocking elements are transferable, by movement of at least one part of said blocking arrangement relative to the main body, from a functional position, in which the inclination of said main body relative to the supporting element is possible, into a blocking position, in which the inclination of said main body relative to the supporting element is not possible, and back into the functional position.

9. The support according to claim 1, wherein said contact base is an integral part of said main body or an intermediate piece configured to interacts with said main body, and abuts against said main body.

10. The support according to claim 1, wherein interacting contact surfaces of said contact base and said contact head are arranged obliquely relative to the horizontal.

11. The support according to claim 10, wherein said interacting contact surfaces are arranged obliquely to the horizontal in a state in said contact surfaces slope up from front to rear, in a longitudinal direction of the seat.

12. A mechanism for a piece of seating furniture, the mechanism comprising a support according to claim 1.

13. The mechanism according to claim 12, wherein the seating furniture is a chair.

14. The mechanism according to claim 12, configured as a synchronous mechanism, an asynchronous mechanism, or a tilting mechanism.

15. A piece of seating furniture, comprising a support according to claim 1.

16. The piece of seating furniture according to claim 15, wherein said support is an integral part of a mechanism for the seating furniture.

17. The piece of seating furniture according to claim 16, wherein the seating furniture is a chair.

18. A support for seating furniture, comprising:

a main body;

a connecting unit fitted to said main body, said connecting unit being configured for connecting the support to a supporting element of an underframe and having a mount for the supporting element;

said connecting unit being fitted on said main body to enable an inclination of said main body to be altered relative to the supporting element, wherein said main body has a contact base which, in a fitted state of said connecting unit, is in contact with a contact head of said connecting unit and abuts with said contact head at a given point forming a non-planar contact; and a restoring arrangement with a plurality of restoring elements, wherein, upon an inclination of said main body relative to the supporting element, at least one of said restoring elements is activated by said connecting unit, in particular by the contact head;

said connecting unit being fitted on said main body such that said restoring elements of said restoring arrangement are supported on said contact head of said connecting unit and on a support element that is fixed to said main body;

said support element being a closure cover fixed to said main body and closing off an accommodating space of said main body that accommodates said connecting unit at least partially.

19. A support for seating furniture, comprising:

a main body;

a connecting unit fitted to said main body, said connecting unit being configured for connecting the support to a supporting element of an underframe and having a mount for the supporting element;

said connecting unit being fitted on said main body to enable an inclination of said main body to be altered relative to the supporting element, wherein said main body has a contact base which, in a fitted state of said connecting unit, is in contact with a contact head of said connecting unit and abuts with said contact head at a given point forming a non-planar contact; and a blocking arrangement having a plurality of first blocking elements, said first blocking elements being transferable, by movement of at least one part of said blocking arrangement relative to the main body, from a functional position, in which the inclination of said main body relative to the supporting element is possible, into a blocking position, in which the inclination of said main body relative to the supporting element is not possible, and back into the functional position.

20. The support according to claim 19, wherein, in the blocking position, said first blocking elements of said blocking arrangement interact with second blocking elements, which are arranged on said connecting unit, to give a form fit which prevents relative movement between said main body and the supporting element.

* * * * *